United States Patent [19]

Kamp

[11] Patent Number: 4,516,268

[45] Date of Patent: May 7, 1985

[54] PENTABAR CLOSURE DEVICE

[75] Inventor: Ewald A. Kamp, Chicago, Ill.

[73] Assignee: Union Carbide Corporation, Danbury, Conn.

[21] Appl. No.: 518,537

[22] Filed: Jul. 29, 1983

Related U.S. Application Data

[63] Continuation of Ser. No. 400,114, Jul. 20, 1982, abandoned, which is a continuation of Ser. No. 972,428, Dec. 22, 1978, abandoned.

[51] Int. Cl.[3] ..... A44B 17/00; A44B 19/00

[52] U.S. Cl. ..... 383/63

[58] Field of Search ..... 383/63–65; 24/587

[56] References Cited

U.S. PATENT DOCUMENTS

| | | | |
|---|---|---|---|
| 2,144,755 | 1/1939 | Freedman | 383/63 |
| 3,038,225 | 6/1962 | Ausnit | 24/587 |
| 3,220,076 | 11/1965 | Ausnit et al. | 383/64 |
| 3,338,285 | 8/1967 | Jaster | 383/63 |
| 3,425,469 | 2/1969 | Ausnit | 383/65 |
| 3,654,049 | 4/1972 | Ausnit | 383/65 |
| 3,808,649 | 5/1974 | Ausnit | 383/63 |
| 4,046,408 | 9/1977 | Ausnit | 383/63 |

*Primary Examiner*—Stephen P. Garbe

*Attorney, Agent, or Firm*—John C. Lefever; Real J. Grandmaison

[57] ABSTRACT

A container comprises a flexible closure device and a pouch portion, and the closure device comprises a first flexible closure strip including a pair of first hooks, and a second flexible closure strip including a pair of second hooks and a ridge positioned to facilitate and maintain the occlusion of the closure strips.

8 Claims, 9 Drawing Figures

FIG. 4
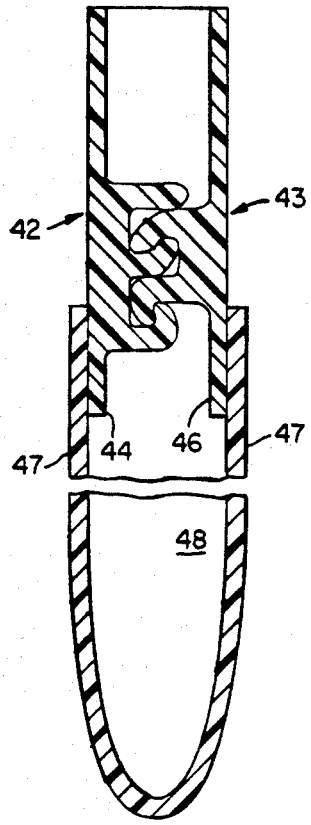
FIG. 5
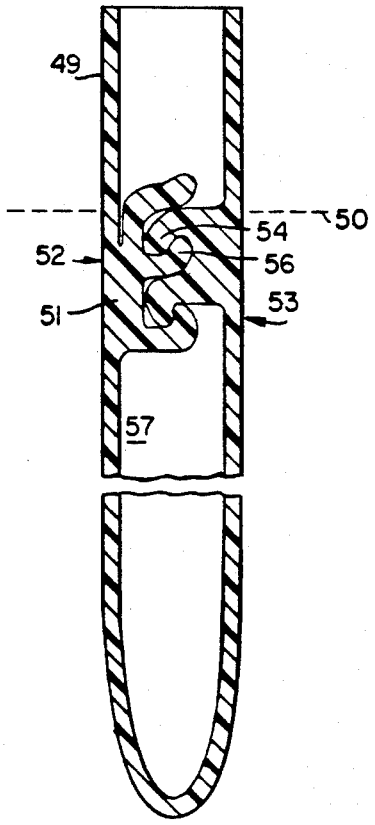
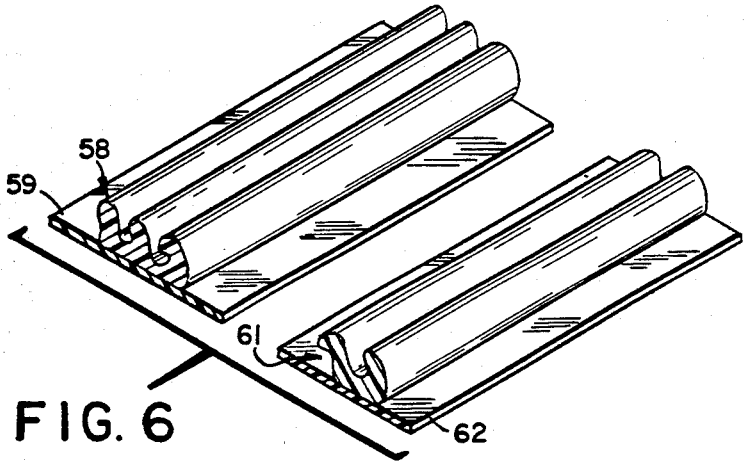
FIG. 6

PENTABAR CLOSURE DEVICE

This application is a continuation of my prior application Ser. No. 400,114 filed July 20, 1982, now abandoned, which is a continuation of application Ser. No. 972,428 filed Dec. 22, 1978, now abandoned.

The invention relates to a container and more particularly to a container including interlocking interdigitating flexible closure strips.

Generally, containers comprising reuseable closure devices and pouches are well-known in the art. In addition, manufacturing methods for such containers are well-known in the art. Generally, the containers are made from plastic material and the closure devices and pouches thereof can be made integrally by extrusion as a unitary piece or can be made as separate components which are subsequently permanently connected together.

Containers of the type considered herein have wide consumer use and usually feature a flexible pouch and a closure device which can generally withstand most forces which would tend to open the container by accident. There is a growing need for a container having a recloseable closure device which is particularly resistant to accidental opening due to large forces arising from inside the pouch.

The instant invention provides a container which features a flexible closure device which can be easily opened by forces applied to the closure device along an external region intended for that purpose whereas the closure device strongly resists being opened by forces arising from pressure within the pouch portion of the container.

The foregoing criteria for a container are met by one embodiment of the present invention which embodiment comprises a flexible closure device and a pouch portion including two side walls and two side edges, the closure device comprising first and second flexible closure strips arranged in confronting relationship to each other and permanently connected to each other at the two side edges, the first closure strip having two opposite sides, one side of which is generally flat and connected to one side wall of the pouch portion and the other side of which defines a pair of first hooks, each of the first hooks extending in the direction of the interior of the pouch portion, the second closure strip having two opposite sides, one side of which is generally flat and connected to the side wall of the pouch portion and the other side of which defines a ridge and a pair of second hooks, each of the second hooks extending in a direction away from the interior of the pouch portion, the pairs of first and second hooks being operable for resiliently engaging and disengaging with each other and the ridge being positioned on the side of the pair of second hooks away from the interior of the pouch portion and being operable to guide the first and second closure strips for occlusion and to maintain the occlusion.

Another embodiment of the invention is the aforementioned container wherein the closure device features the hooks near the interior of the pouch portion having a relatively high negative angle of engagement.

A further embodiment of the invention is the aforementioned container wherein the hooks near the interior of the pouch portion have a high negative angle of engagement and the other hooks distal from the interior of the pouch portion having a relatively positive angle of engagement.

A further embodiment of the invention is the aforementioned container wherein each of the closure strips includes a flange portion extending away from the interior of the pouch portion.

A still further embodiment of the invention is the aforementioned container including the closure device wherein the second closure strip includes a flange portion which extends from a region generally opposite the first hook which is distal from the interior of the pouch portion so that forces applied to the flange portion for disengaging the occluded closure device will be generally displaced from the center of action of the closure strips.

The invention accordingly comprises features of construction, combination of elements and arrangements of parts which will be exemplified in a construction hereinafter set forth and the scope of the application of which will be indicated in the claims.

Generally, the container of the invention and particularly the closure device, can be made from polyethylene, polypropelene, nylon, or another thermoplastic material or the like or a combination thereof. The dimensions of the closure device would vary in accordance with the technology depending upon the materials used because of the variation in physical properties such as moduli.

The container of the invention can be manufactured by known methods which include extrusion and the use of molds. The container can be produced by the integral extrusion of the film for the container with the closure strips. Other methods include extruding the closure strips onto a preformed film or extruding a film onto preformed closure strips. For these methods, the fusion between the film and closure strips results from the hot extrudate adhering to a compatible polymer.

Known methods for connecting the closure strips to a plastic film for defining a container include the use of thermoelectric devices such as heated rotary discs, or resistance heated slide wires, or travelling heater bands, or the like.

The connection between the plastic film and closure strips can also be established by the use of hot melt adhesives, or hot jets of air to the interface or ultrasonic heating, or other known methods.

Another advantage of the present invention is that it can be cleaned and reused more easily than typical prior art containers intended for the same purposes such as described in U.S. Pat. No. 3,054,434 Ausnit et al. This patent requires one of the closure elements to have a hinged connection to the pouch in order to resist high forces from the interior of the pouch. This hinge could present difficulty in cleaning the container.

The present container provides many advantages to consumers, particularly because the closure device is reusable and yet surprisingly is resistant to being opened by relatively large pressures from within the pouch portion.

For a fuller understanding of the nature and objects of the invention, reference should be had to the following detailed description, taken in connection with the accompanying drawings, in which.

Figure 3A:
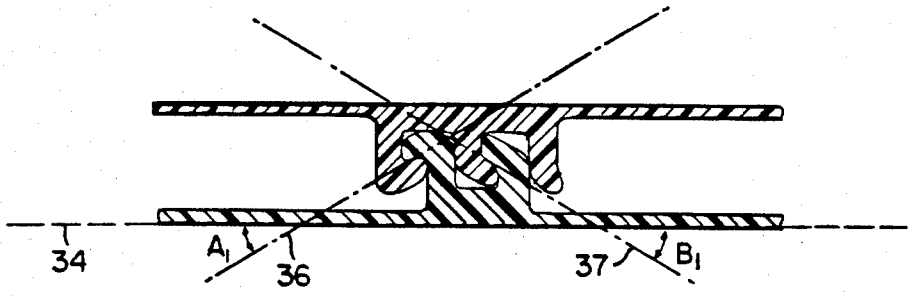
Figure 3B:
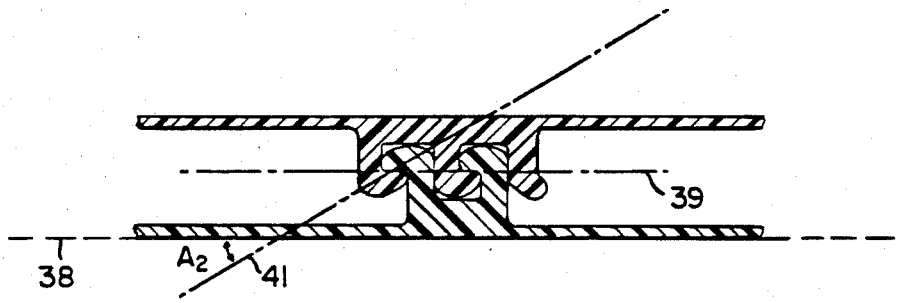
Figure 3C:
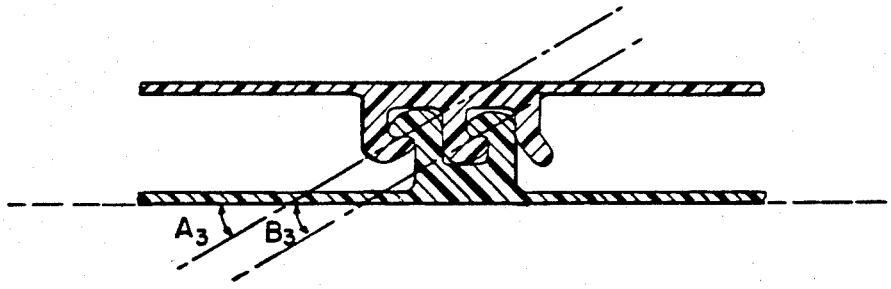

FIGS. 3A, 3B, and 3C show diagrammatic and sectional views of three embodiments of the invention;

FIG. 4 shows a diagrammatic and sectional view of a further embodiment of the invention;

FIG. 5 shows a diagrammatic and sectional view of yet another embodiment of the invention; and FIG. 6 shows a perspective view of a closure device of the invention in the form of tapes or strips.

In carrying the invention into effect, certain embodiments have been selected for illustration in the accompanying drawings and for description in this specification, reference being had to FIGS. 1 to 6.

Figure 1:
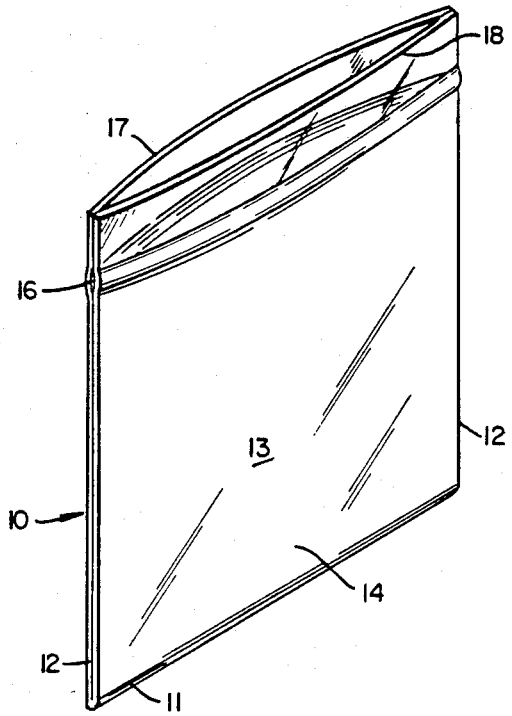
FIG. 1 is a perspective view of a container in accordance with the invention.

FIG. 1 shows a typical flexible container 10 formed from a thin, plastic film which has been folded at the bottom portion 11 and has been heat sealed along the vertical side edges 12 to form a pouch portion 13.

Side walls 14 extend beyond a closure device 16 to provide mouth portions 17 and 18 to simplify the opening of the closure device 16.

Figure 2A:
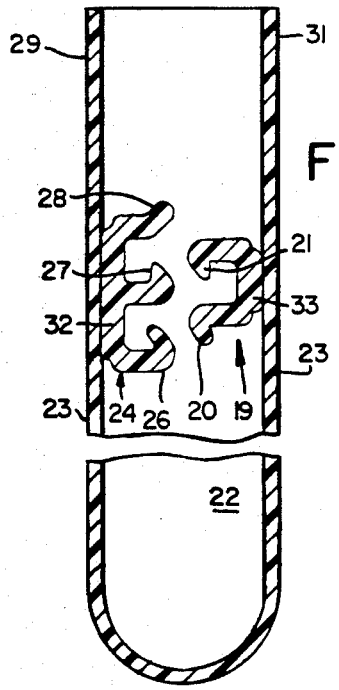
FIGS. 2A and 2B show diagrammatic and sectional views of portions of one embodiment of the invention both in the unoccluded and occluded states.
Figure 2B:
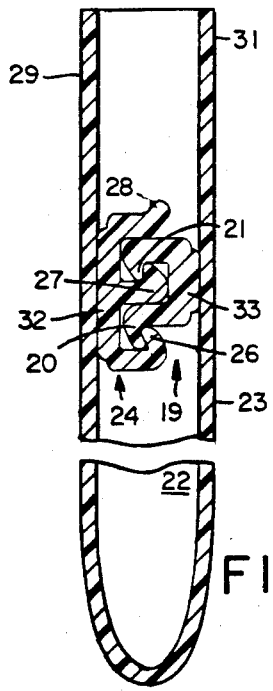

One embodiment of the invention is shown in the open and occluded positions in FIGS. 2A and 2B. A first flexible closure strip 19 has first hooks 20 and 21 defined on one side and extending in the direction of the interior of a pouch portion 22. A generally flat surface opposite side of the closure strip 19 is connected to a side wall 23.

A second flexible closure strip 24 on one side has a pair of second hooks 26 and 27 defined as well as a ridge 28. The second hooks 26 and 27 extend in a direction away from the interior of the pouch portion 22 and are operable for resiliently engaging and disengaging with the first hooks 20 and 21 as shown in the FIGS. 2A and 2B. The ridge 28 is positioned on the side of the second hooks 26 and 27 away from the interior of the pouch portion 22 and is operable to guide the closure strips 19 and 24 for occlusion and to maintain occlusion while permitting disengagement. That is, when spreading forces are applied to flanges 29 and 31 the bases 32 and 33 flex to facilitate the disengagement of the closure strips 19 and 24.

The closure strips 19 and 24 are connected by connecting means such as an adhesive to sidewalls 23.

As used herein, the angle of engagement is the angle between a straight line approximately defined by the flat side of the first closure strip and a straight line approximately defined by the contact surfaces of a pair of engaged hooks. Reference is had to FIGS. 3A, 3B, and 3C whch show various combinations of angles of engagement for different embodiments.

As used herein, a negative angle of engagement occurs when the line defined by the contact surfaces of a pair of hooks intersects the line defined by the flat side of the first closure strip on the side of the reference pair of contact surfaces towards the interior of the pouch portion. In FIG. 3A, the angle of engagement $A_1$ is defined by lines 34 and 36 and is an example of a negative angle of engagement.

As used herein, the positive angle of engagement occurs when the line defined by the contact surfaces of a pair of hooks intersects the line defined by the flat side of the first closure strip on the side of the reference pair of contact surfaces away from the interior of the pouch portion. In FIG. 3A, the angle of engagement $B_1$ is defined by the lines 34 and 37 and is a positive angle of engagement.

As used herein, a zero angle of engagement occurs when the line defined by the contact surfaces of a pair of hook intersects the line defined by the flat side of the first closure strip remotely and, ideally, if the two lines are parallel. In FIG. 3B, a zero angle of engagement is indicated by the lines 38 and 39, whereas lines 38 and 41 show a negative angle of engagement, $A_2$.

In FIG. 3C, the angles of engagements $A_3$ and $B_3$ are both negative angles of engagement.

It can be readily realized that the force needed to disengage hooks having a negative angle of engagement is generally greater than the force necessary to disengage hooks having a zero or positive angle of engagement.

It has now been realized a relatively high negative angle of engagement can be used for the angle of engagement between the hooks near the interior of a pouch portion in order to provide an occluded closure device highly resistant to disengagement from forces arising from within the pouch portion. The use, however, of a positive or negative angle of engagement for the hooks away from the interior of the pouch in conjunction with the aforementioned relatively high negative angle of engagement surprisingly provides a container which both resists being opened by forces arising from the interior of the pouch portion and is relatively easy to open by the application of forces at the outside flanges of the closure device.

The opening of an occluded closure device of the invention as shown in FIG. 2B can be analyzed as follows. For forces arising from the interior of the pouch portion 22, the hook 20 tends to rotate into the hook 26 and thereby tends to maintain occlusion. When a person wants to disengage the closure strips 19 and 24, spreading forces are applied to the flanges 29 and 31. These forces flex bases 32 and 33 so that the ridge 28 is rotated away from the hook 21, thereby allowing the hook 21 to be released from the hook 27 and then the hook 20 rotates out of the hook 26.

FIG. 4 shows another embodiment of the invention in which the closure strips 42 and 43 have been made through separate operations and connected at flanges 44 and 46 to side walls 47 of a pouch portion 48 using connecting means such as an adhesive.

FIG. 5 shows an integrally extruded embodiment of the invention which is similar to the embodiment shown in FIGS. 2A and 2B but has the additional feature of flange 49 being connected to the base 51 of closure strip 52 so that forces applied to flange 49 for disengaging closure strips 52 and 53 will be applied below the action line 50 for the closure strips 52 and 53.

This embodiment compensates for a relatively high positive angle of engagement for hooks 54 and 56 which are distal to the pouch portion 57 and provides the additional advantage of increasing the resistance of the closure strips 52 and 53 from accidentally opening due to friction or pressure against a relatively filled pouch portion 57.

FIG. 6 shows a perspective view of the tapes or strips of the invention with flanges for use in an embodiment as shown in FIG. 4. Closure strip 58 includes a flange portion 59, while closure strip 61 includes a flange portion 62.

I wish it to be understood that I do not desire to be limited to exact details of construction shown and described, for obvious modifications will occur to a person skilled in the art.

Having thus described the invention, what I claim as new and desire to be secured by Letters Patent is as follows:

1. A container comprising a flexible closure device and a pouch portion including two side walls and two side edges;

said closure device comprising first and second flexible closure strips arranged in confronting relationship to each other and permanently connected to each other at the two side edges;

said first closure strip having two opposite sides, one side of said first closure strip is generally flat and connected to one side wall of said pouch portion and the other side of said first closure strip consists of a pair of first hooks;

each of said first hooks extending in the direction of the interior of said pouch portion;

said second closure strip having two opposite sides, one side of said second closure strip is generally flat and connected to the other side wall of said pouch portion and the other side of said second closure strip consists of a ridge and a pair of second hooks;

each of said second hooks extending in a direction away from the interior of said pouch portion;

said pairs of first and second hooks being operable for resiliently engaging and disengaging with each other and said ridge being positioned on the side of said pair of second hooks away from the interior of said pouch portion and being operable to guide said first and second closure strips for occlusion and to maintain the occlusion;

wherein the hooks near the interior of said pouch portion have a negative angle of engagement when said closure device is occluded, and wherein the hooks distal to said pouch portion have a positive angle of engagement when said closure device is occluded.

2. A container as in claim 1 wherein each of said closure strips includes a flange portion.

3. A container as in claim 1 wherein said second closure strip includes a flange portion extending away from said pouch portion and which is connected to said second closure strip in a region generally opposite the first hook of said second closure strip which is distal from the interior of said pouch portion.

4. A container as in claim 1 wherein said side walls are connected to said closure strips due to integral extrusion.

5. A container as in claim 1 wherein said side walls are connected to said closure strips by an adhesive.

6. A container comprising a flexible closure device and a pouch portion including two side walls and two side edges;

said closure device comprising first and second flexible closure strips arranged in confronting relationship to each other and permanently connected to each other at the two side edges;

said first closure strip having two opposite sides, one side of said first closure strip is generally flat and connected to one side wall of said pouch portion and the other side of said first closure strip consists of a pair of first hooks;

each of said first hooks extending in the direction of the interior of said pouch portion;

said second closure strip having two opposite sides, one side of said second closure strip is generally flat and connected to the other side wall of said pouch portion and the other side of said second closure strip consists of a ridge and a pair of second hooks;

each of said second hooks extending in a direction away from the interior of said pouch portion;

said pairs of first and second hooks being operable for resiliently engaging and disengaging with each other and said ridge being positioned on the side of said pair of second hooks away from the interior of said pouch portion and being operable to guide said first and second closure strips for occlusion and to maintain the occlusion;

wherein the hooks near the interior of said pouch portion have a negative angle of engagement when said closure device is occluded, and wherein the hooks distal to said pouch portion have a zero angle of engagement when said closure device is occluded.

7. A container comprising a flexible closure device and a pouch portion including two side walls and two side edges;

said closure device comprising first and second flexible closure strips arranged in confronting relationship to each other and permanently connected to each other at the two side edges;

said first closure strip having two opposite sides, one side of said first closure strip is generally flat and connected to one side wall of said pouch portion and the other side of said first closure strip consists of a pair of first hooks;

each of said first hooks extending in the direction of the interior of said pouch portion;

said second closure strip having two opposite sides, one side of said second closure strip is generally flat and connected to the other side wall of said pouch portion and the other side of said second closure strip consists of a ridge and a pair of second hooks;

each of said second hooks extending in a direction away from the interior of said pouch portion;

said second closure strip including a flange portion which extends from a region generally opposite the first hook which is distal from the interior of said pouch portion;

said pairs of first and second hooks being operable for resiliently engaging and disengaging with each other and said ridge being positioned on the side of said pair of second hooks away from the interior of said pouch portion and being operable to guide said first and second closure strips of occlusion and to maintain the occlusion;

wherein the hooks near the interior of said pouch portion have a negative angle of engagement when said closure device is occluded, and wherein the hooks distal to said pouch portion have a positive angle of engagement when said closure device is occluded.

8. A container comprising a flexible closure device and a pouch portion including two side walls and two side edges;

said closure device comprising first and second flexible closure strips arranged in confronting relationship to each other and permanently connected to each other at the two side edges;

said first closure strip having two opposite sides, one side of said first closure strip is generally flat and connected to one side wall of said pouch portion and the other side of said first closure strip consists of a pair of first hooks;

each of said first hooks extending in the direction of the interior of said pouch portion;

said second closure strip having two opposite sides, one side of said second closure strip is generally flat and connected to the other side wall of said pouch portion and the other side of said second closure strip consists of a ridge and a pair of second hooks;

each of said second hooks extending in a direction away from the interior of said pouch portion;

said second closure strip including a flange portion which extends from a region generally opposite the first hook which is distal from the interior of said pouch portion;

said pairs of first and second hooks being operable for resiliently engaging and disengaging with each other and said ridge being positioned on the side of said pair of second hooks away from the interior of said pouch portion and being operable to guide said first and second closure strips for occlusion and to maintain the occlusion;

wherein the hooks near the interior of said pouch portion have a negative angle of engagement when said closure device is occluded, and wherein the hooks distal to said pouch portion have a zero angle of engagement when said closure device is occluded.

* * * * *